US006460924B1

(12) United States Patent
Josephs

(10) Patent No.: US 6,460,924 B1
(45) Date of Patent: Oct. 8, 2002

(54) CONVERTIBLE TABLE AND BENCH COMBINATION FOR CHILDREN

(76) Inventor: Lorraine M. Josephs, 147-32 253rd St., Rosedale, NY (US) 11422

( * ) Notice: Subject to any disclaimer, the term of this patent is extended or adjusted under 35 U.S.C. 154(b) by 180 days.

(21) Appl. No.: 09/688,914

(22) Filed: Oct. 16, 2000

(51) Int. Cl.[7] ..... A47B 3/06

(52) U.S. Cl. ..... 297/158.5; 297/188.01; 297/440.1

(58) Field of Search ..... 108/26; 297/172, 297/158.3, 158.5, 118, 188.01, 440.1, 440.22, 174 R, 174 CS

(56) References Cited

U.S. PATENT DOCUMENTS 3,148,636 A * 9/1964 Bloomquist et al.
5,070,795 A 12/1991 Redlin et al. ..... 108/26
5,251,955 A * 10/1993 Sarafa
D341,521 S 11/1993 Norbury et al. ..... D7/616
5,285,991 A 2/1994 Carlson ..... 248/311.2
5,454,537 A 10/1995 Meeker et al. ..... 248/220.1
5,535,682 A 7/1996 Aigeldinger ..... 108/25
5,803,536 A * 9/1998 Perzee et al.
5,865,124 A * 2/1999 Wroe
6,186,590 B1 * 2/2001 Tseng
6,298,793 B1 * 10/2001 Turner et al.

* cited by examiner

*Primary Examiner*—Milton Nelson, Jr.

(57) ABSTRACT

A convertible table and bench combination for children that includes a table and a pair of benches. The table includes an apron, a pair of legs, and a table top. Each leg includes a foot that has two pair of throughbores. The table top rests invertibly in the apron and has pair of through cutouts for grasping by hands for facilitating inversion thereof, an uppermost surface that has plate recesses that replaceably hold plates therein for preventing the plates from being knocked over by the children and glass recesses that replaceably hold glasses therein for preventing the glasses from being knocked over by the children, and a lowermost surface that is completely flat so as to provide a work surface for the children when eating is over, the plates and the glasses are removed, and the table top is lifted and inverted. The pair of benches are interlockingly attached to the table by tongues that interlock in associated pairs of throughbores in the feet of the pair of legs for holding the pair of benches to the table even when the children seating in the seating areas of the pair of benches are squirming.

29 Claims, 2 Drawing Sheets

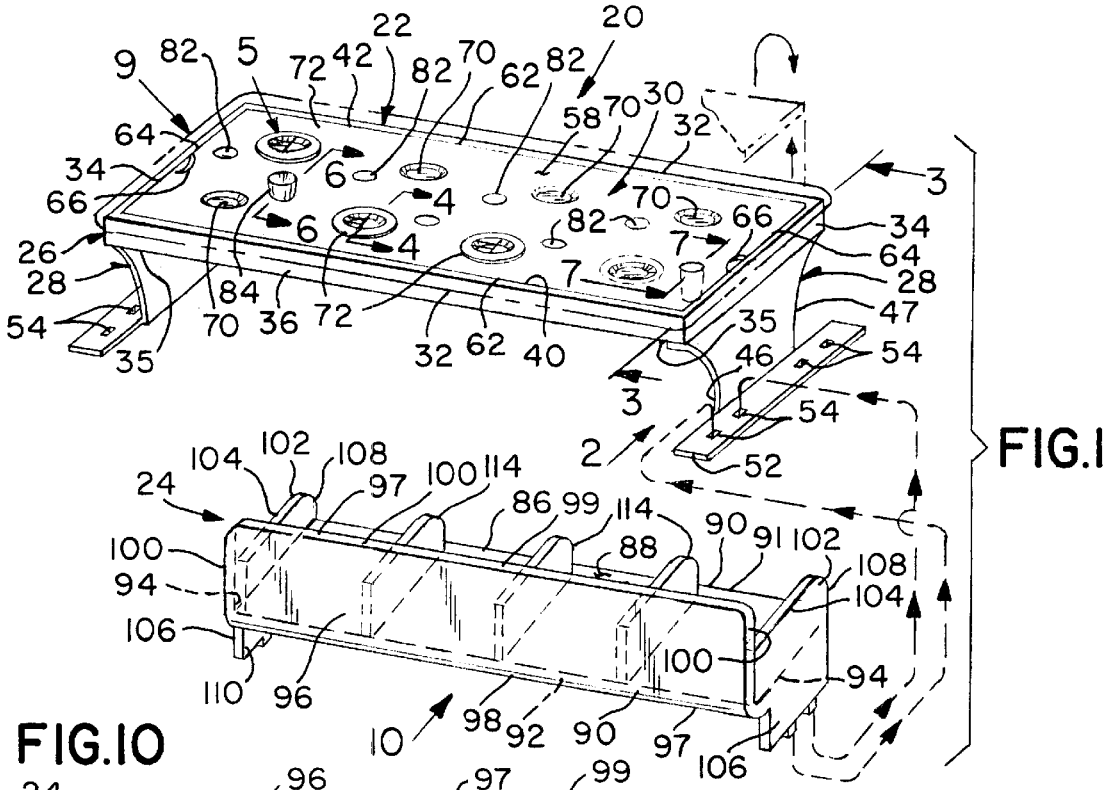
FIG.1
FIG.10
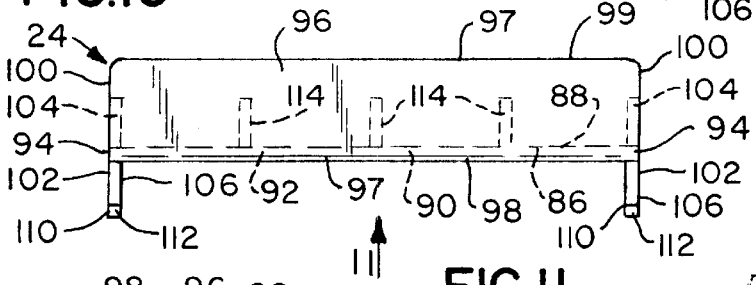
FIG.11
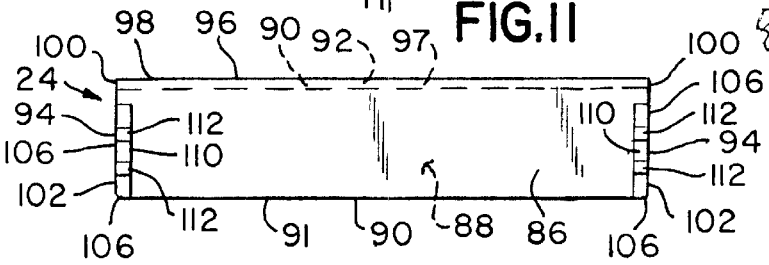
FIG.4
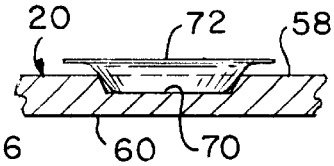
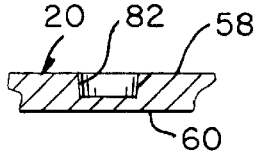
FIG.7
FIG.6
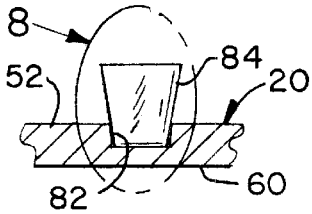

FIG.9
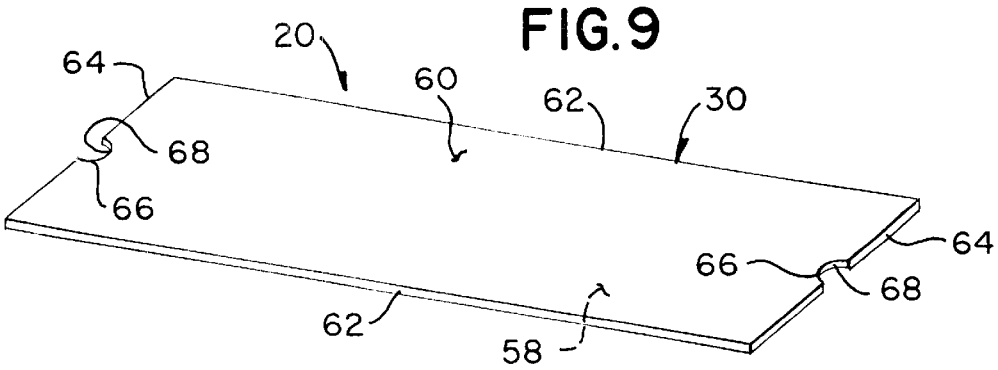
FIG.5
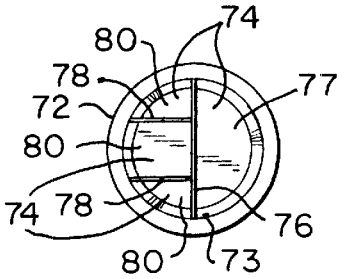
FIG.2
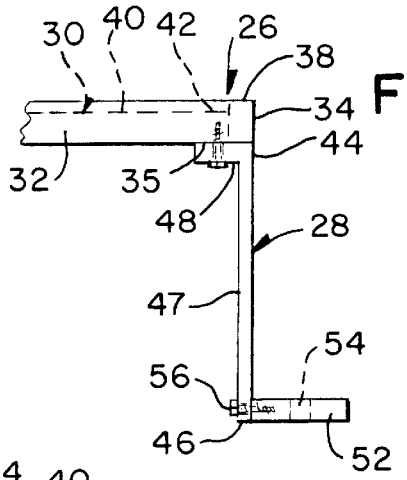
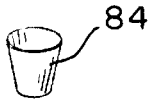
FIG.8
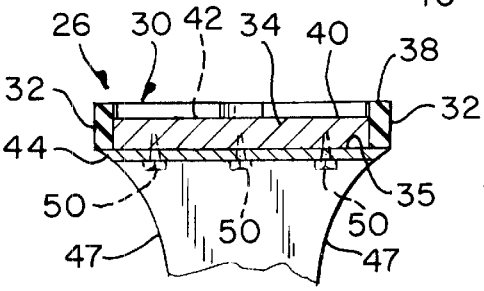
FIG.3

CONVERTIBLE TABLE AND BENCH COMBINATION FOR CHILDREN

BACKGROUND OF THE INVENTION

1. Field of the Invention

The present invention relates to a table and bench combination for children. More particularly, the present invention relates to a convertible table and bench combination for children.

2. Description of the Prior Art

Numerous innovations for food and beverage holder related devices have been provided in the prior art that will be described. Even though these innovations may be suitable for the specific individual purposes to which they address, however, they differ from the present invention.

A FIRST EXAMPLE, U.S. Pat. No. Des. 341,521 to Norbury et al. teaches the ornamental design for a portable tray for tumblers and bowl.

A SECOND EXAMPLE, U.S. Pat. No. 5,070,795 to Redlin et al. teaches an apparatus mounted to a bottom surface of a table, wherein the apparatus includes a support plate and an elongate circuitous pivot leg mounting a support tray member at a forward terminal end of the pivot leg. The pivot leg includes a "U" shaped leg portion to complementarily received an adjoining table leg from a positioning of the pivot leg within an elongate recess of an associated positioning strut mounted to the adjoining table leg. The support tray includes a plurality of cup receiving apertures and may further include a cylindrical insulative sponge-like cylinder to receive a beverage container therewithin, as well as a freezable gel insert sleeve positionable within the cylinder to provide selective refrigeration of a beverage container mounted within the support tray structure.

A THIRD EXAMPLE, U.S. Pat. No. 5,285,991 to Carlson teaches a food and/or beverage holding system for mounting on a card table having a card table leg assembly. The system includes a food or beverage holder mounted radially to a base sized to separate the holder far enough from a hook extension, for sanitary reasons, the base being mounted radially from its other end to a table leg receptacle for providing vertical stability, and from the base or table leg receptacle, the hook extends axially upwardly therefrom for removable attachment to one ore more table leg lateral projections. The food and/or beverage holding system may be removably constructed for separating one or more major members from the remainder of the apparatus to enhance portability.

A FOURTH EXAMPLE, U.S. Pat. No. 5,454,537 to Meeker et al. teaches a cup holder that is provided to attach to a piece of furniture. The cup holder includes a base formed to include spaced-apart side-by-side cup receiving receptacles, a mounting fixture appended to the base, and spaced-apart furniture engaging clamps appended to the mounting fixture. The mounting fixture includes a V-shaped channel formed by a V-shaped side wall and a V-shaped flange which allows the cup holder to engage two sides of the piece of furniture (e.g., the corner of a table).

A FIFTH EXAMPLE, U.S. Pat. No. 5,535,682 to Aigeldinger teaches a utility table having a top and foldable legs. The top has openings. On the underside of the top, flexible strips extend across the respective openings. Each opening and strip form an open-sided pocket for drinking containers. The folding of the legs up against the top is accommodated by the flexible strips being gathered between the legs and the top.

It is apparent that numerous innovations for food and beverage holder related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a convertible table and bench combination for children that avoids the disadvantages of the prior art.

ANOTHER OBJECT of the present invention is to provide a convertible table and bench combination for children that is simple and inexpensive to manufacture.

STILL ANOTHER OBJECT of the present invention is to provide a convertible table and bench combination for children that is simple to use.

BRIEFLY STATED, YET ANOTHER OBJECT of the present invention is to provide a convertible table and bench combination for children that includes a table and a pair of benches. The table includes an apron, a pair of legs, and a table top. Each leg includes a foot that has two pair of throughbores. The table top rests invertibly in the apron and has pair of through cutouts for grasping by hands for facilitating inversion thereof, an uppermost surface that has plate recesses that replaceably hold plates therein for preventing the plates from being knocked over by the children and glass recesses that replaceably hold glasses therein for preventing the glasses from being knocked over by the children, and a lowermost surface that is completely flat so as to provide a work surface for the children when eating is over, the plates and the glasses are removed, and the table top is lifted and inverted. The pair of benches are interlockingly attached to the table by tongues that interlock in associated pairs of throughbores in the feet of the pair of legs for holding the pair of benches to the table even when the children seating in the seating areas of the pair of benches are squirming.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is an exploded diagrammatic perspective view of the present invention;

FIG. 2 is an enlarged diagrammatic front elevational view taken generally in the direction of arrow 2 in FIG. 1 of a leg of the present invention;

FIG. 3 is an enlarged diagrammatic cross sectional view taken on line 3—3 in FIG. 1;

FIG. 4 is an enlarged diagrammatic cross sectional view taken on line 4—4 in FIG. 1 of the table top of the present invention holding a plate of the present invention;

FIG. 5 is a top plan view of a plate of the present invention;

FIG. 6 is an enlarged diagrammatic cross sectional view taken on line 6—6 in FIG. 1 of the table top of the present invention holding a glass of the present invention;

FIG. 7 is an enlarged diagrammatic cross sectional view taken on line 7—7 in FIG. 1 of a glass receptacle in the table top of the present invention;

FIG. 8 is a diagrammatic perspective view of the area generally enclosed by the dotted curve identified by arrow 8 in FIG. 6 of the glass of the present invention;

FIG. 9 is an enlarged diagrammatic perspective view of the area generally enclosed by the dotted curve identified by arrow 9 in FIG. 1 of the table top of the present invention inverted;

FIG. 10 is a diagrammatic rear elevational view taken generally in the direction of arrow 10 in FIG. 1 of a bench of the present invention; and FIG. 11 is a diagrammatic bottom plan view taken generally in the direction of arrow 11 in FIG. 10 of the bench of the present invention.

LIST OF REFERENCE NUMERALS UTILIZED IN THE DRAWING

20 convertible table and bench combination of present invention for children
22 table
24 pair of benches
26 apron of table 22
28 pair of legs of table 22
30 table top of table 22
32 pair of long beams of apron 26 of table 22
34 pair of short beams of apron 26 of table 22
35 lowermost terminal surfaces of pair of short beams 34 of apron 26 of table 22
36 frame of apron 26 of table 22
38 uppermost surface of frame 36 of apron 26 of table 22
40 through opening defined by frame 36 of apron 26 of table 22
42 relief in uppermost surface 38 of frame 36 of apron 26 of table 22
44 uppermost terminal edge of each leg of pair of legs 28 of table 22
46 lowermost terminal edge of each leg of pair of legs 28 of table 22
47 pair of free edges of each leg of pair of legs 28 of table 22
48 ledger of each leg of pair of legs 28 of table 22
three first lag bolts of each leg of pair of legs 28 of table 22
52 foot of each leg of pair of legs 28 of table 22
54 two pair of throughbores in foot 52 of each leg of pair of legs 28 of table 22
56 three second lag bolts of each leg of pair of legs 28 of table 22
58 uppermost surface of table top 20 of table 22
60 lowermost surface of table top 20 of table 22
62 pair of long edges of table top 20 of table 22
64 pair of short edges of table top 20 of table 22
66 midpoints of pair of short edges 64 of table top 20 of table 22
68 pair of through cutouts in table top 20 of table 22 for grasping by hands for facilitating inversion of table top 30 of table 22 in relief 42 in uppermost surface 38 of frame 36 of apron 26 of table 22
70 plate recesses in uppermost surface 58 of table top 30 of table 22 for preventing knocking over of plates 72 by children
72 plates
73 perimeter of each plate of plates 72
74 four compartments of each plate of plates 72
76 first partition of each plate of plates 72
77 primary compartment of four compartments 74 of each plate of plates 72 for main food
78 pair of second partitions of each plate of plates 72
80 three secondary compartments of four compartments 74 of each plate of plates 72 for side foods
82 glass recesses in uppermost surface 58 of table top 30 of table 22 for preventing knocking over of glasses 84 by children
84 glasses
86 seat of each bench of pair of benches 24
88 uppermost surface of seat 86 of each bench of pair of benches 24
90 pair of long edges of seat 86 of each bench of pair of benches 24
91 forwardmost long edge of pair of long edges 90 of seat 86 of each bench of pair of benches 24
92 rearwardmost long edge of pair of long edges 90 of seat 86 of each bench of pair of benches 24
94 pair of short edges of seat 86 of each bench of pair of benches 24
96 back of each bench of pair of benches 24
97 pair of long edges of back 96 of each bench of pair of benches 24
98 lowermost long edge of pair of long edges 97 of back 96 of each bench of pair of benches 24
99 uppermost long edge of pair of long edges 97 of back 96 of each bench of pair of benches 24
100 pair of short edges of back 96 of each bench of pair of benches 24
102 pair of sides of each bench of pair of benches 24
104 upper portions of pair of sides 102 of each bench of pair of benches 24
106 lower portions of pair of sides 102 of each bench of pair of benches 24
108 forwardmost short edge of upper portions 104 of pair of sides 102 of each bench of pair of benches 24
110 lowermost edge of lower portions 104 of pair of sides 102 of each bench of pair of benches 24
112 pair of tongues depending from lower portion 104 of each side of pair of sides 102 of each bench of pair of benches 24
114 three partitions of each bench of pair of benches 24

DESCRIPTION OF THE PREFERRED EMBODIMENT

Referring now to the figures, in which like numerals indicate like parts, and particularly to FIG. 1, the convertible table and bench combination of the present invention is shown generally at 20 for children.

The overall configuration of the convertible table and bench combination 20 can best be seen in FIG. 1, and as such, will be discussed with reference thereto.

The convertible table and bench combination 20 comprises a table 22 that has a length, and a pair of benches 24 that are replaceably attached to the table 22 and have seating areas for the children.

The overall configuration of the table 22 can best be seen in FIG. 1, and as such, will be discussed with reference thereto.

The table 22 comprises an apron 26, a pair of legs 28 that depend from the apron 26, and a table top 30 that is operatively connected to the apron 26.

The specific configuration of the apron 26 can best be seen in FIG. 1, and as such, will be discussed with reference thereto.

The apron 26 comprises a pair of long beams 32 that are slender, elongated, and rectangular-parallelepiped-shaped, and a pair of short beams 34 that are slender, elongated, and rectangular-parallelepiped-shaped, have entire lengths and lowermost terminal surfaces 35, are shorter than the pair of long beams 32 thereof, and together therewith, form a frame 36 that is rectangular-shaped, horizontally-oriented, has an uppermost surface 38, and defines an through opening 40.

The uppermost surface 38 of the frame 36 has a relief 42 that is horizontally-oriented and extends continuously and completely therearound and communicates with the through opening 40 defined by the frame 36.

The specific configuration of each leg 28 can best be seen in FIGS. 1–3, and as such, will be discussed with reference thereto.

Each leg 28 extends across, is flush with, and depends from, an associated short beam 34 of the frame 36.

Each leg 28 is a sheet that extends from an uppermost terminal edge 44 thereof along the entire length of an associated short beam 34 of the frame 36, depends vertically therefrom to a lowermost terminal edge 46 thereof, and has a pair of free edges 47 that depend from the uppermost terminal edge 44 thereof to the lowermost terminal edge 46 thereof.

The pair of free edges 47 of each leg 28 taper arcuately inwardly towards each other, in a direction of the associated short beam 34 of the frame 36, from the uppermost terminal edge of an associated leg 28 to the lowermost terminal edge 46 of the associated leg 28 so as to provide clearance for the pair of benches 24, respectively.

Each leg 28 further comprises a ledger 48 that is horizontally-oriented, slender, elongated, rectangular-parallelepiped-shaped, and extends integrally inwardly along the uppermost terminal edge 44 of an associated leg 28.

Each leg 28 further comprises three first lag bolts 50 that extend vertically upwardly and freely into the ledger 48 of an associated leg 28 and threadably into the lowermost surface 35 of an associated short beam 34 so as to replaceably attach the associated leg 28 to the frame 26 for easy removal, transport, and storage.

Each leg 28 further comprises a foot 52 that is horizontally-oriented, slender, elongated, rectangular-parallelepiped-shaped, and extends laterally outwardly along the lowermost terminal edge 46 of an associated leg 28, past an associated short beam 34 of the frame 26, and longitudinally outwardly past both free edges 47 of the associated leg 28.

The foot 52 of each leg 28 has two pair of throughbores 54 that are rectangular-shaped, extend vertically therethrough, and are spaced longitudinally therealong.

Each pair of throughbores 54 in the foot 52 of an associated leg 28 are disposed outboard of, so as to clear, an associated free edge 47 of the associated leg 28.

Each leg 28 further comprises three second lag bolts 56 that extend horizontally outwardly and freely into the lowermost terminal edge 46 of an associated leg 28 and threadably into the foot 52 of the associated leg 28 so as to replaceably attach the foot 52 of the associated leg 28 to the associated leg 28 for easy removal, transport, and storage.

The specific configuration of the table top 30 can best be seen in FIGS. 1 and 4–9, and as such, will be discussed with reference thereto.

The table top 20 is a sheet that replaceably rests invertibly and freely in the relief 42 in the uppermost surface 38 of the frame 36.

The table top 20 has an uppermost surface 58, a lowermost surface 60, and is rectangular-shaped so by definition further has a pair of long edges 62 and a pair of short edges 64 with midpoints 66.

The table top 20 further has a pair of through cutouts 68 that extend inwardly from, and communicate with, the midpoints 66 of the pair of short edges 64 thereof, respectively, for grasping by hands for facilitating inversion of the table top 30 in the relief 42 in the uppermost surface 38 of the frame 36.

The uppermost surface 58 of the table top 30 has plate recesses 70 that are circular-shaped and depend taperingly therein, terminate short of, so as to allow flat maintenance of, the lowermost surface 60 of the table top 30, and replaceably hold plates 72 therein to a point where the plates 72 are steady for preventing knocking over by the children, by virtue of the circular-shape and tapering.

The plate recesses 70 in the uppermost surface 58 of the table top 30 are so positioned therein so as to allow the plates 72 replaceably held therein to be so positioned so as to be compatible with the seating areas of the pair of benches 24 for easy access by, but without being knocked over by, the children sitting on the pair of benches 24.

Each plate 72 has a perimeter 73 and is divided into four compartments 74 by a first partition 76 that extends diametrically thereacross to the perimeter 73 thereof and provides a primary compartment 77 for a main food (not shown), and a pair of second partitions 78 that are parallel to, and spaced-apart from, each other, and extend perpendicularly outwardly from the first partition 76 thereof to the perimeter 73 thereof and provide three secondary compartments 80 for side foods (not shown).

The uppermost surface 58 of the table top 30 further has glass recesses 82 that are circular-shaped and depend taperingly therein, terminate short of, so as to allow flat maintenance of, the lowermost surface 60 of the table top 30, and replaceably hold glasses 84 therein to a point where the glasses 84 are steady for preventing knocking over by the children, by virtue of the circular-shaped and tapering.

The glass recesses 82 in the uppermost surface 58 of the table top 30 are so positioned therein so as to allow the glasses 84 replaceably held therein to be so positioned so as to be compatible with the plates 72 and the seating areas of the pair of benches 24 for easy access by, but without being knocked over by, the children sitting on the pair of benches 24.

The lowermost surface 60 of the table top 30 is completely flat so as Up provide a work surface for the children when eating is over, the plates 72 and the glasses 84 are removed, and the table top 30 is lifted and inverted in the relief 42 in the uppermost surface 38 of the frame 36 by use of the through cutouts 68 in the table top 20.

The specific configuration of each bench 24 can best be seen in FIGS. 1, 10, and 11, and as such, will be discussed with reference thereto.

Each bench 24 is replaceably and interlockingly attached to, and extends the length of, the table 22.

Each bench 24 comprises a seat 86 that is flat, horizontally-oriented, has an uppermost surface 88, and is rectangular shaped, and as a result thereof, has a pair of long edges 90 that include a forwardmost long edge 91 and a rearwardmost long edge 92, and a pair of short edges 94, which by definition, are shorter than the pair of long edges 90 thereof.

Each bench 24 further comprises a back 96 that is flat, vertically-oriented, rectangular-shaped, and as a result thereof, has a pair of long edges 97 that include a lowermost long edge 98 and an uppermost long edge 99, and a pair of short edges 100.

The lowermost long edge 98 of the back 96 of the bench 24 is coincident with the rearwardmost long edge 92 of the seat 86, with the back 96 extending vertically upwardly therefrom and horizontally from one short edge 94 of the seat 86 to the other short edge 94 of the seat 86.

Each bench 24 further comprises a pair of sides 102 that are flat, vertically-oriented, and have upper portions 104 and lower portions 106.

The upper portion 104 of each side 102 of each bench 24 is flat, rectangular-shaped, and extends vertically perpendicularly upwardly from an associated short edge 94 of the seat 86 to short of the uppermost long edge 99 of the back 96, and horizontally perpendicularly forwardly from an associated short edge 100 of the back 96 to the forwardmost long edge 91 of the seat 86, where the upper portion 104 terminates in a forwardmost edge 108.

The lower portion 104 of each side 102 of each bench 24 is flat, rectangular-shaped, and depends vertically from the associated short edge 94 of the seat 86, coplanarly with the upper portion 104 of an associated side 102, to a lowermost edge 110 thereof that replaceably abuts against the foot 52 of an associated leg 28 of the table 22, and extends rearwardly from the forwardmost edge 106 of the upper portion 104 of the associated side 102 to short of the back 96.

The lower portion 104 of each side 102 of each bench 24 further has a pair of tongues 112 that are rectangular-parallelepiped-shaped, spaced-apart from each other, depend from the lowermost edge 110 of the lower portion 104 of an associated side 102 of an associated bench 24, and replaceably interlock in an associated pair of throughbores 54 in the foot 52 of an associated leg 28 for holding the pair of benches 24 to the table 22 even when the children seating in the seating areas of the pair of benches 24 are squirming.

Each bench further comprises three partitions 114 that are flat, vertically-oriented, replicate and are aligned with, the upper portions 104 of the pair of sides 102, and extend vertically perpendicularly upwardly from, and are spaced along, the uppermost surface 88 of the seat 86 and horizontally perpendicularly forwardly from the back 96, and divide the bench 24 into the seating areas.

It will be understood that each of the elements described above, or two or more together, may also find a useful application in other types of constructions differing from the types described above.

While the invention has been illustrated and described as embodied in a convertible table and bench combination for children, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A convertible table and bench combination for children, comprising:

a) a table having a length; and b) a pair of benches being replaceably attached to said table and having seating areas for the children;

wherein said table comprises:

a) an apron;

b) a pair of legs that depend from said apron; and c) a table top that is operatively connected to said apron;

wherein said apron comprises:

a) a pair of long beams that are slender, elongated, and rectangular-parallelepiped-shaped; and b) a pair of short beams that are slender, elongated, and rectangular-parallelepiped-shaped, have entire lengths and lowermost terminal surfaces, are shorter than said pair of long beams thereof, and together therewith, form a frame that is rectangular-shaped, horizontally-oriented, has an uppermost surface, and defines a through opening.

2. The combination as defined in claim 1, wherein each bench is replaceably and interlockingly attached to, and extends said length of, said table.

3. The combination as defined in claim 1, wherein each leg extends across, is flush with, and depends from, an associated short beam of said frame.

4. The combination as defined in claim 1, wherein said uppermost surface of said frame has a relief that is horizontally-oriented and extends continuously and completely therearound and communicates with said through opening defined by said frame.

5. The combination as defined in claim 4, wherein said table top is a sheet that replaceably rests invertibly and freely in said relief in said uppermost surface of said frame.

6. The combination as defined in claim 4, wherein said table top has:

a) an uppermost surface;

b) a lowermost surface, and is rectangular-shaped so by definition further has:

c) a pair of long edges; and d) a pair of short edges with midpoints.

7. The combination as defined in claim 6, wherein said table top further has a pair of through cutouts that extend inwardly from, and communicate with, said midpoints of said pair of short edges thereof, respectively, for grasping by hands for facilitating inversion of said table top in said relief in said uppermost surface of said frame.

8. The combination as defined in claim 7, wherein said uppermost surface of said table top has plate recesses that are circular-shaped and depend taperingly therein, terminate short of, so as to allow flat maintenance of, said lowermost surface of said table top, and replaceably hold plates therein to a point where said plates are steady for preventing knocking over by the children, by virtue of said circular-shape and tapering.

9. The combination as defined in claim 8, wherein each plate has a perimeter and is divided into four compartments by:

a) a first partition that extends diametrically thereacross to said perimeter thereof and provides a primary compartment for a main food; and b) a pair of second partitions that are parallel to, and spaced-apart from, each other, and extend perpendicularly outwardly from said first partition thereof to said perimeter thereof and provide three secondary compartments for side foods.

10. The combination as defined in claim 8, wherein said plate recesses in said uppermost surface of said table top are so positioned therein so as to allow said plates replaceably held therein to be so positioned so as to be compatible with said seating areas of said a pair of benches for easy access by, but without being knocked over by, the children when sitting on said pair of benches.

11. The combination as defined in claim 10, wherein said uppermost surface of said table top further has glass recesses that are circular-shaped and depend taperingly therein, terminate short of, so as to allow flat maintenance of, said lowermost surface of said table top, and replaceably hold glasses therein to a point where said glasses are steady for preventing knocking over by the children, by virtue of said circular-shaped and tapering.

12. The combination as defined in claim 11, wherein said glass recesses in said uppermost surface of said table top are so positioned therein so as to allow said glasses replaceably held therein to be so positioned so as to be compatible with said plates and said seating areas of said a pair of benches for easy access by, but without being knocked over by, the children when sitting on said pair of benches.

13. The combination as defined in claim 11, wherein said lowermost surface of said table top is completely flat so as to provide a work surface for the children when eating is over, said plates and said glasses are removed, and said table top is lifted and inverted in said relief in said uppermost surface of said frame by use of said through cutouts in said table top.

14. The combination as defined in claim 1, wherein each leg is a sheet that extends from an uppermost terminal edge thereof along said entire length of an associated short beam of said frame, depends vertically therefrom to a lowermost terminal edge thereof, and has a pair of free edges that depend from said uppermost terminal edge thereof to said lowermost terminal edge thereof.

15. The combination as defined in claim 14, wherein said pair of free edges of each leg taper arcuately inwardly towards each other, in a direction of said associated short beam of said frame, from said uppermost terminal edge of an associated leg to said lowermost terminal edge of said associated leg so as to provide clearance for each of said pair of benches, respectively.

16. The combination as defined in claim 14, wherein each leg further comprises a ledger that is horizontally-oriented, slender, elongated, rectangular-parallelepiped-shaped and extends integrally inwardly along said uppermost terminal edge of an associated leg.

17. The combination as defined in claim 16, wherein each leg further comprises three first lag bolts that extend vertically upwardly and freely into said ledger of an associated leg and threadably into said lowermost surface of an associated short beam of said frame so as to replaceably attach said associated leg to said frame for easy removal, transport, and storage.

18. The combination as defined in claim 14, wherein each leg further comprises a foot that is horizontally-oriented, slender, elongated, rectangular-parallelepiped-shaped, and extends laterally outwardly along said lowermost terminal edge of an associated leg, past an associated short beam of said frame, and longitudinally outwardly past both free edges of said associated leg.

19. The combination as defined in claim 18, wherein each leg further comprises three second lag bolts that extend horizontally outwardly and freely into said lowermost terminal edge of an associated leg and threadably into said foot of said associated leg so as to replaceably attach said foot of said associated leg to said associated leg for easy removal, transport, and storage.

20. The combination as defined in claim 18, wherein each foot of each leg has two pair of throughbores that are rectangular-shaped, extend vertically therethrough, and are spaced longitudinally therealong.

21. The combination as defined in claim 20, wherein each pair of throughbores in said foot of an associated leg are disposed outboard of, so as to clear, an associated free edge of said associated leg.

22. The combination as defined in claim 20, wherein each bench comprises a seat that is flat, horizontally-oriented, has an uppermost surface, and is rectangular shaped, and as a result thereof, has:

a) a pair of long edges that include:
   i) a forwardmost long edge; and
   ii) a rearwardmost long edge; and b) a pair of short edges, which by definition, are shorter than said pair of long edges thereof.

23. The combination as defined in claim 22, wherein each bench further comprises a back that is flat, vertically-oriented, rectangular-shaped, and as a result thereof, has:

a) a pair of long edges that include:
   i) a lowermost long edge; and
   ii) an uppermost long edge; and b) a pair of short edges.

24. The combination as defined in claim 23, wherein said lowermost long edge of said back of said bench is coincident with said rearwardmost long edge of said seat, with said back extending vertically upwardly therefrom and horizontally from one short edge of said seat to the other short edge of said seat.

25. The combination as defined in claim 23, wherein each bench further comprises a pair of sides that are flat, vertically-oriented, and have:

a) upper portions; and b) lower portions.

26. The combination as defined in claim 25, wherein each bench further comprises three partitions that are flat, vertically-oriented, replicate and are aligned with, said upper portions of said pair of sides, and extend vertically perpendicularly upwardly from, and are spaced along, said uppermost surface of said seat and horizontally perpendicularly forwardly from said back, and divide said bench into said seating areas.

27. The combination as defined in claim 25, wherein said upper portion of each side of each bench is flat, rectangular-shaped, and extends vertically perpendicularly upwardly from an associated short edge of said seat to short of said uppermost long edge of said back, and horizontally perpendicularly forwardly from an associated short edge of back to said forwardmost long edge of said seat, where said upper portion terminates in a forwardmost edge.

28. The combination as defined in claim 27, wherein said lower portion of each side of each bench is flat, rectangular-shaped, and depends vertically from said associated short edge of said seat, coplanarly with said upper portion of an associated side, to a lowermost edge thereof that replaceably abuts against said foot of an associated leg of said table, and extends rearwardly from said forwardmost edge of said upper portion of said associated side to short of said back.

29. The combination as defined in claim 28, wherein said lower portion of each side of each bench further has a pair of tongues that are rectangular-parallelepiped-shaped, spaced-apart from each other, depend from said lowermost edge of said lower portion of an associated side of an associated bench, and replaceably interlock in an associated pair of throughbores in said foot of an associated leg for holding said pair of benches to said table even when the children sitting in said seating areas of said pair of benches are squirming.

* * * * *